US007399340B2

(12) United States Patent
Strauss

(10) Patent No.: US 7,399,340 B2
(45) Date of Patent: Jul. 15, 2008

(54) REPLACEMENT DISCHARGE ELECTRODE FOR ELECTROSTATIC PRECIPITATORS AND METHOD OF ASSEMBLY

(75) Inventor: Robert A. Strauss, Raritan, NJ (US)

(73) Assignee: Hamon Research_Cottrell, Inc., Somerville, NJ (US)

( * ) Notice: Subject to any disclaimer, the term of this patent is extended or adjusted under 35 U.S.C. 154(b) by 136 days.

(21) Appl. No.: 11/448,329

(22) Filed: Jun. 7, 2006

(65) Prior Publication Data

US 2006/0278083 A1 Dec. 14, 2006

Related U.S. Application Data

(60) Provisional application No. 60/688,490, filed on Jun. 8, 2005.

(51) Int. Cl.
*B03C 3/41* (2006.01)

(52) U.S. Cl. ..... 95/57; 96/89; 96/95; 96/97

(58) Field of Classification Search ..... 96/89–91, 96/95, 97; 95/57

See application file for complete search history.

(56) References Cited

U.S. PATENT DOCUMENTS

| | | | | | |
|---|---|---|---|---|---|
| 1,357,201 | A | * | 10/1920 | Nesbit | 95/79 |
| 1,399,422 | A | * | 12/1921 | Chubb | 96/95 |
| 2,409,579 | A | * | 10/1946 | Meston | 96/97 |
| 2,505,907 | A | * | 5/1950 | Meston | 96/97 |
| 3,046,716 | A | * | 7/1962 | Rodger | 96/97 |
| 3,485,011 | A | * | 12/1969 | Archer et al. | 95/81 |
| 3,765,154 | A | * | 10/1973 | Hardt et al. | 96/88 |
| 4,106,919 | A | * | 8/1978 | Lagerdahl | 96/90 |
| 4,247,307 | A | * | 1/1981 | Chang | 95/79 |
| 4,375,364 | A | * | 3/1983 | Van Hoesen et al. | 96/87 |
| 4,502,872 | A | * | 3/1985 | Ivester et al. | 96/90 |
| 4,514,195 | A | * | 4/1985 | Coe, Jr. | 96/97 |
| 4,666,474 | A | * | 5/1987 | Cook | 96/90 |
| 4,948,399 | A | * | 8/1990 | Reuffurth et al. | 96/92 |
| 5,210,678 | A | * | 5/1993 | Lain et al. | 361/226 |
| 5,254,155 | A | * | 10/1993 | Mensi | 96/44 |
| 5,296,019 | A | * | 3/1994 | Oakley et al. | 96/95 |
| 5,391,222 | A | * | 2/1995 | Nelson et al. | 96/90 |
| 5,547,496 | A | * | 8/1996 | Hara | 96/79 |
| 5,603,752 | A | * | 2/1997 | Hara | 96/39 |
| 6,176,902 | B1 | * | 1/2001 | Matsubara | 96/66 |
| 7,048,787 | B2 | * | 5/2006 | Svadil et al. | 96/97 |
| 2006/0254423 | A1 | * | 11/2006 | Tanaka et al. | 96/66 |

FOREIGN PATENT DOCUMENTS

| | | | | | |
|---|---|---|---|---|---|
| JP | 6-142550 | A | * | 5/1994 | 96/95 |

* cited by examiner

*Primary Examiner*—Richard L Chiesa
(74) *Attorney, Agent, or Firm*—Howard & Howard Attorneys, P.C.

(57) ABSTRACT

A replacement discharge electrode including a plurality of tubular telescopically assemblable discharge elements, and a tensioning element, tensioning the cable when the tubular telescopically assemblable discharge elements are aligned forming a rigid unitary tubular replacement discharge electrode. The discharge electrode components include abuttable tubular sections, center support tubes telescopically received within the abuttable tubular sections and outer tubular sleeves or collars, forming a rigid discharge electrode having excellent electrical properties. The method includes loosely assembling the tubular component on a flexible cable and tensioning the cable to form a rigid mast-type discharge electrode.

18 Claims, 4 Drawing Sheets

20
28
26
32
24
22
30

REPLACEMENT DISCHARGE ELECTRODE FOR ELECTROSTATIC PRECIPITATORS AND METHOD OF ASSEMBLY

RELATED APPLICATIONS

This application claims priority to Provisional Application Ser. No. 60/688,490, filed Jun. 8, 2005.

FIELD OF THE INVENTION

This invention relates to replacement discharge electrodes for electrostatic precipitators and methods of assembling replacement discharge electrodes in situ, thereby reducing down time, labor and costs. More specifically, this invention relates to a collapsible mass-type replacement discharge electrode which may be easily manufactured, shipped in unassembled components to an electrostatic precipitator, assembled adjacent to or within the electrostatic precipitator housing and form a rigid discharge electrode assembly, and method of assembly.

BACKGROUND OF THE INVENTION

Electrostatic precipitators are efficient and economical in removing particulates from the effluent of combustion processes, such as boilers, furnaces and the like. Electrostatic precipitators were first developed and implemented nearly 100 years ago by the predecessor-in-interest of the assignee of this Application, Hamon Research-Cottrell, Inc.

An electrostatic precipitator typically includes a chamber having a plurality of vertical spaced parallel large conductive panels or collecting electrodes which are rigidly mounted in vertical spaced relation in the chamber. At the centerpoints running between the conductive panels or collecting electrodes are a series of individual discharge electrodes that generally run vertically the full height of the collecting electrodes. For many years, the basic discharge electrode system for electrostatic precipitators consisted of flexible weighted wires hung vertically downwardly from an upper high voltage structure of the precipitator, which wire-discharge electrodes are provided with tensioning blades at the lower ends. More recently, as disclosed in U.S. Pat. No. 4,375,364, assigned to the predecessor-in-interest of the Assignee of this Application, such flexible wire-type discharge electrodes were replaced with rigid "mast-type" discharge electrodes supported on an insulating assembly keeping them electrically isolated from the collecting electrodes. A high voltage direct current is applied to the opposing surfaces of the collecting and discharge electrodes, such that a positive charge is applied to the collecting electrodes and a negative charge is applied to the discharge electrodes. In a typical application, the mast-type discharge electrodes are generally cylindrical, having a plurality of thin spaced pointed radial spikes which create an electrical field between the negatively charged discharge electrodes and the spaced panel-shaped collecting electrodes. However, flexible wire-discharge electrodes are still in use. When particulate-laden waste gases are received at low velocity through this electrical field, the particulates in the waste gas stream become negatively charged and are thus attracted to the positive charge on the surfaces of the positively charged collecting electrodes. When the migration of the negatively charged particulates is complete, the inherent resistivity of the particulates will prevent complete loss of the negative charge to the collecting electrode surface. The retained opposing negative charge in the particles will cause the particulates to agglomerate on the surface of the collecting electrodes.

As will be understood by those skilled in this art, in recent decades the environmental laws have become even more stringent in limiting the discharge of particulates into the atmosphere, such that even slight emissions of particulates into the atmosphere can result in large fines and production cutbacks or shutdowns. These more stringent regulations have resulted in major changes in the physical design of electrostatic precipitators, resulting in "sectionalization", which are large electrostatic precipitators with many small electrical sections to increase efficiency and reduce the loss percentage in the event of failure of one section of the electrostatic precipitator. Although the flexible wire-type discharge electrodes are more efficient, the rigid mast-type discharge electrodes are more reliable, resulting in a preference for rigid mast-type discharge electrodes. Since the construction of the rigid mast-type discharge electrode is larger than the wire-type discharge electrodes, the rigid mast-type discharge electrodes are less efficient at producing an electrical corona at the same voltage, and thus, it became necessary to change the geometry of the electrostatic precipitator to larger conductive plate collecting electrodes, increase the spacing between the collecting electrodes, and raising the voltage to a higher level to achieve satisfactory corona discharge from the rigid mast-type discharge electrodes in the wider spaced precipitators.

As will be understood, however, even more reliable rigid mast-type discharge electrodes eventually require replacement due to general aging or failure due to temperature surges caused by process upset conditions or precipitator fires. However, placement or replacement of rigid mast-type discharge electrodes is difficult and expensive, requiring lengthy down-time for the electrostatic precipitator and the entire unit and process generally has to be shut down. Replacement of rigid mast-type discharge electrodes also generally requires large holes or openings to be cut in the roof of the electrostatic precipitator, often holes must be cut in the surrounding building structure and cranes are required to lift and lower the large rigid mast-type discharge electrodes, which may be 12 to 54 feet in length and are generally about two inches in diameter having radial discharge emission elements or pointed spikes, as described above.

There is, therefore, a long-standing need for replacement discharge electrodes which reduce down-time of the electrostatic precipitator, labor and cost. The rigid mast-type replacement discharge electrodes of this invention may be manufactured at a remote facility, the components easily shipped to the electrostatic precipitator, easily inserted in small or existing openings within the electrostatic precipitator casing and reassembled internally with minimum and significantly reduced labor, tools and electrostatic precipitator down-time.

SUMMARY OF THE INVENTION

In one preferred embodiment of the replacement discharge electrode of this invention, a plurality of tubular elements which preferably may be assembled are assembled on a cable, which is loosely received through the tubular components, permitting "folding" or collapsing of the assembly for receipt through small openings in the casing of the electrostatic precipitator and between or adjacent the collecting electrodes of an existing electrostatic precipitator, and a tensioning element which tensions the cable when the components are assembled, preferably in abutting relation, into a rigid unitary tubular discharge electrode. In one preferred embodiment, the components of the assembly include a plurality of tubular abutting sections of the discharge electrode which are telescopically received over center support tubes and tubular sleeves are then telescopically received over the abutting ends of the tubular sections, forming a rigid unitary discharge electrode upon tightening or tensioning of the cable. As will be understood, the loosely assembled components on the tensioning cable may thus be folded prior to being inserted through existing openings in the electrostatic precipitator casing and reassembled internally in the electrostatic precipitator prior to reassembly into a rigid unitary tubular discharge electrode and mounting between the collecting electrodes. As will also be understood, the replacement discharge electrode of this invention may be used to replace rigid mast-type discharge electrodes or flexible wire-type discharge electrodes. The tubular components of the collapsible mast-type replacement discharge electrode of this invention may thus be manufactured at a remote facility and easily shipped to the electrostatic precipitator for assembly as described herein.

Thus, the method of assembling replacement discharge electrodes of this invention includes loosely assembling components of a replacement discharge electrode on a cable, moving the assembly between or adjacent to the collecting electrodes, tightening or tensioning the cable to form a unitary rigid discharge electrode, and mounting the replacement discharge electrode between collecting electrodes in the electrostatic precipitator. The preferred sequence of assembly will depend upon the application. For example, the components of the replacement discharge electrodes may be assembled or partially assembled at the manufacturing facility with or without the cable. Then, depending upon assess to the electrical components of the electrostatic precipitator, the components of the replacement discharge electrodes of this invention may be loosely assembled on the cable and finally assembled by tensioning the cable at any convenient location. However, the replacement discharge electrode of this invention has the advantage that the components can be loosely assembled on a cable, folded or collapsed into any convenient shape for receipt through an opening in the casing of the electrostatic precipitator, then raised or moved to adjacent to or between the collecting electrodes, and finally assembled into a rigid mast-type discharge electrode by tensioning the cable. As used herein, the term "cable" is intended to broadly cover any elongated flexible tensioning member, including wires and particularly including flexible braided metal cables which provide strength and flexibility.

Thus, the replacement discharge electrode and method of this invention eliminates the need to make large penetrations or openings in the electrostatic precipitator casing to bring the large rigid discharge electrodes within the casing and eliminates the requirement for cranes or high-lift devices as now required to raise and install conventional rigid mast-type discharge electrodes. Obviously, the replacement discharge electrode and method of this invention also makes it easier to transport the assembly from the point of manufacture to the electrostatic precipitator and eliminates welding or the requirement for special tooling.

The replacement discharge electrode of this invention provides and maintains a correct, rigid alignment of the discharge electrode surface emission elements or spikes and minimizes electrical conductivity across the discharge electrode structural connections to minimize corona generated erosion and is completely compatible with existing rigid mast-type discharge electrodes and may be used to replace flexible wire-type discharge electrodes. Other advantages and meritorious features of the replacement discharge electrode and method of assembly of this invention will be more fully understood from the following description of a preferred embodiment. However, as will be understood by those skilled in this art, various modifications may be made to the disclosed embodiment of the replaceable discharge electrode and method of assembly of this invention within the purview of the appended claims.

DESCRIPTION OF THE PREFERRED EMBODIMENTS

Figures 1A, 1B, 1C:
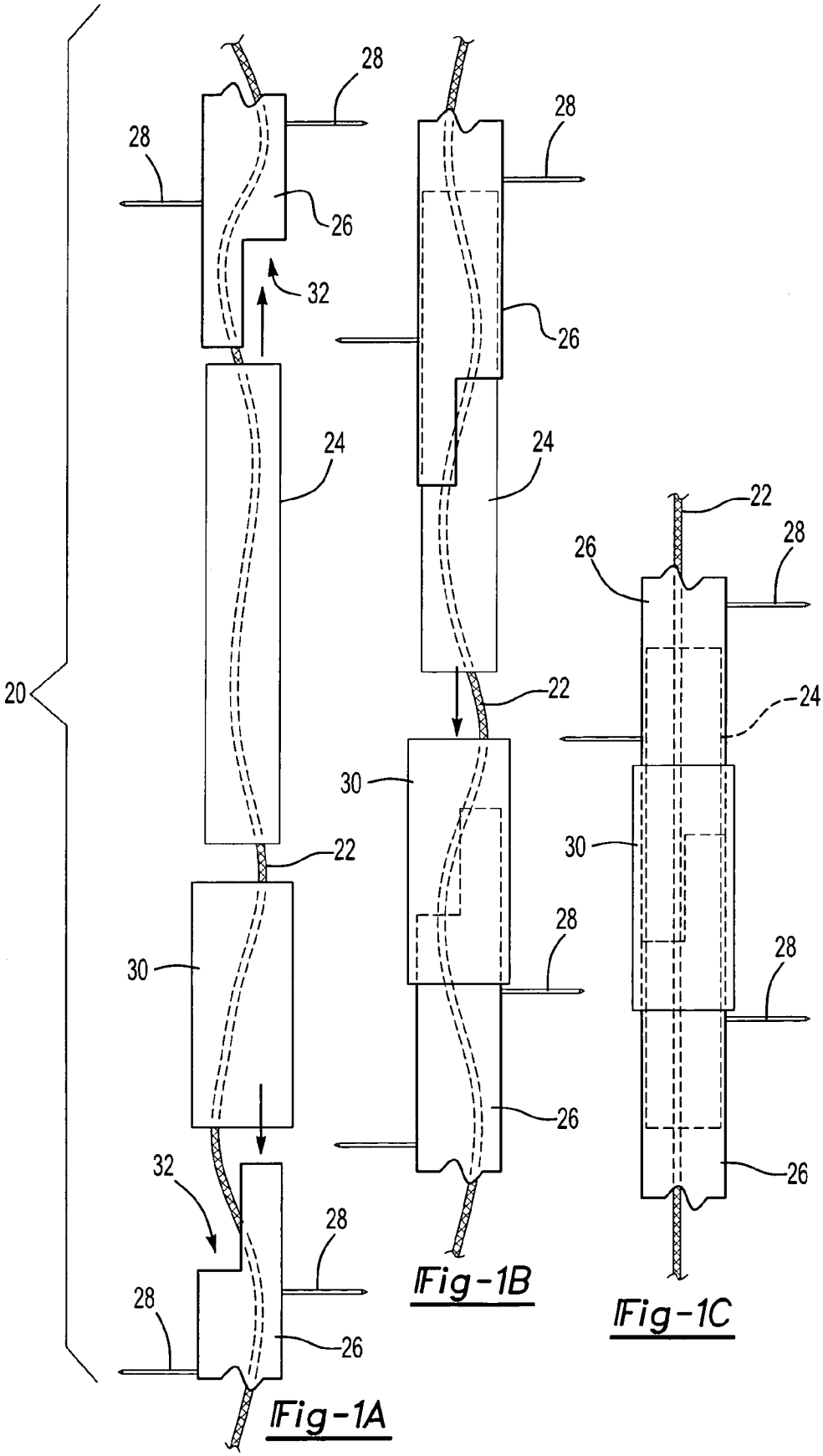
FIG. 1A is a side view of the principal components of one embodiment of the collapsible rigid discharge electrode of this invention loosely assembled on a cable.
FIG. 1B is a side view of the principal components of the embodiment of the rigid discharge electrode shown at FIG. 1A partially assembled.
FIG. 1C is a side view of the principal components of the embodiment of the collapsible rigid discharge electrode shown in FIGS. 1A and 1B assembled.

As set forth above, the disclosed embodiment of the replacement discharge electrode of this invention is for illustrative purposes only and various modifications may be made within the purview of the appended claims. FIGS. 1A to 1C illustrate one embodiment of the components 20 of the replacement discharge electrode of this invention. As discussed further hereinbelow, the components 20 of the replacement discharge electrode are first loosely assembled on a cable 22. In one preferred embodiment, the cable 22 is a braided steel cable, but any elongated flexible tensioning member may be used, including a wire or cable formed from steel, other metals and high tensile strength polymers. The components of the embodiment of the replacement discharge electrode of this invention shown in FIG. 1 includes center support tubes 24 which are telescopically received in the abutting tubular sections 26 of the replacement discharge electrode having discharge electrode discharge elements or radial spikes 28 and outer tubular sleeves or collars 30 which are telescopically received over the abutting ends of the tubular sections 26 of the discharge electrode. In the disclosed embodiment, the abutting ends of the tubular sections 26 each include inter-fitting right angled notches 32 which may be formed by cutting the adjacent ends of the tubular sections along the center line and cut off perpendicular to the center line of the tubular sections to form a tight interlocking abutment between the tubular sections with improved rigidity and conductivity. Although right angled notches are convenient, efficient and easily formed, other shaped notches may also be used. That is, the tubular sections 26 thus interfit as shown in the right hand view of FIG. 1.

In one preferred embodiment of the method of replacing the discharge electrodes of an electrostatic precipitator of this invention, the components 20 of the replacement discharge electrode are first loosely assembled on a cable 22 as shown in FIG. 1A. The components may then be collapsed or "folded" in any suitable configuration on the cable 22 for receipt through available openings into the precipitator casings and assembled for example, either adjacent the collecting electrodes or between the collecting electrodes. Because the components of the discharge electrodes are loosely received on the cable 22, the components 10 can be configured on the cable 22 in any configuration suitable for receipt through available openings. As will be understood, the rigid mast-type discharge electrodes or flexible wire-type discharge electrodes to be replaced may be removed from the electrostatic precipitator in any suitable manner depending upon the mounting. In a typical application as disclosed in the above-referenced U.S. patent, the rigid discharge electrodes are mounted on brackets; however, the mounting of the discharge electrodes will depend upon the application.

When the components 20 of the replacement discharge electrode are delivered to a suitable location, preferably at or within an electrostatic precipitator adjacent or between the collecting electrodes, the components 20 may then be assembled as shown in FIGS. 1B and 1C, wherein the center support tubes 24 are first telescopically received in the tubular sections 26 of the replacement discharge electrode, the tubular sections 26 are then received in abutting relation and the outer tubular sleeves or collars 30 are then telescopically received over the abutting ends of the tubular sections 26 of the discharge electrode. As will be understood, and as shown in FIGS. 1A to 1C, the components 20 of the replacement discharge electrode of this invention may be assembled in various combinations or at any suitable location. Further, certain of the components may be preassembled depending upon the application. For example, some of the sections 26 of the replacement discharge electrode may be welded to the center support tube or pipe 24 prior to final assembly or some of the outer tubular sleeves or collars 30 may be welded to one of the abutting tubular sections 26 prior to assembly. As will be understood, the components 20 are preferably formed of a rigid conductive material, such as iron or steel, and the components preferably closely or tightly telescopically interfit to provide good conductivity through the components following assembly.

Figure 2:
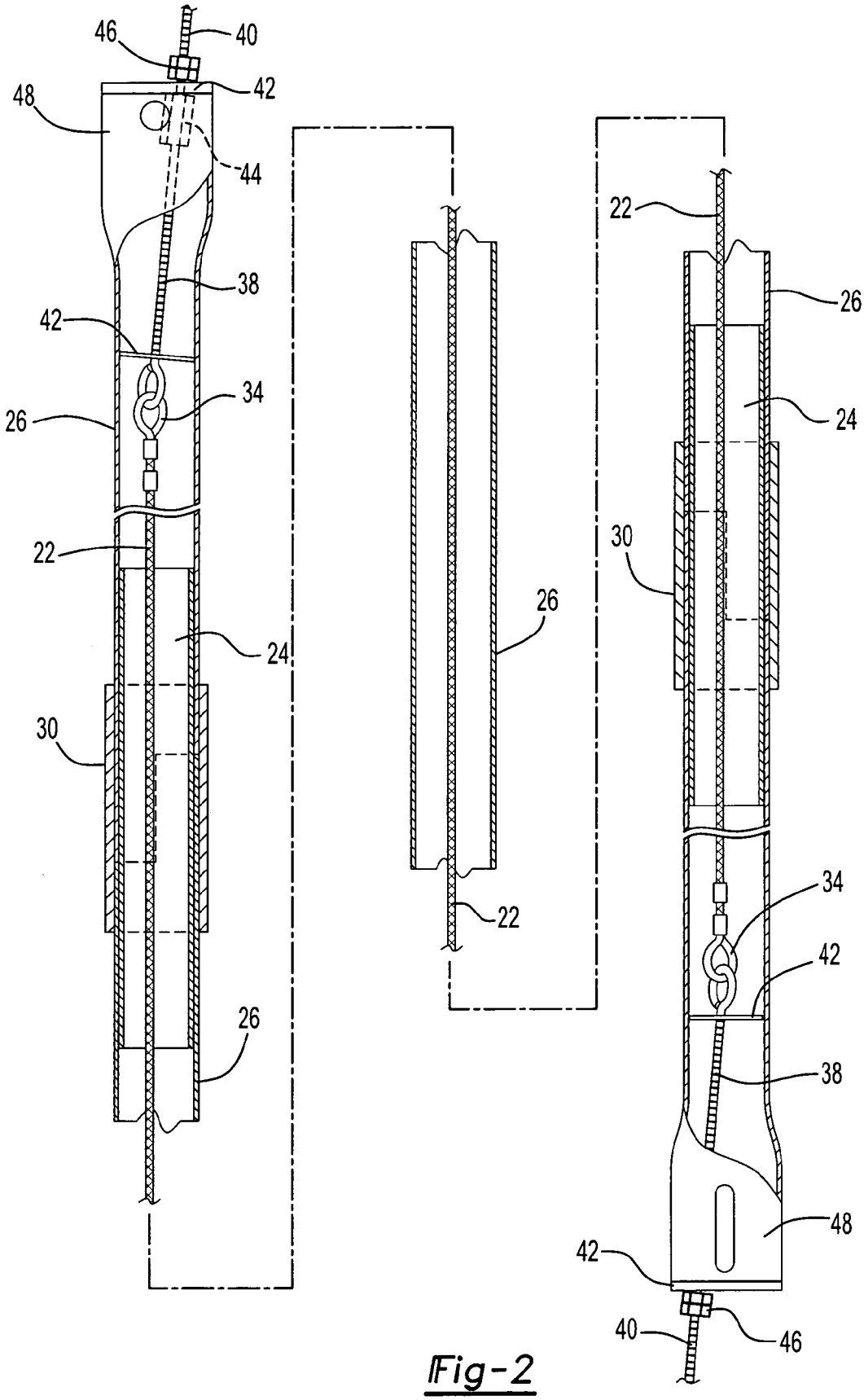
FIG. 2 is a partially exploded cross-sectional side view of an assembled rigid mast-type replacement discharge electrode with the components of the discharge electrode shown in FIGS. 1A to 1C.
Figure 3:
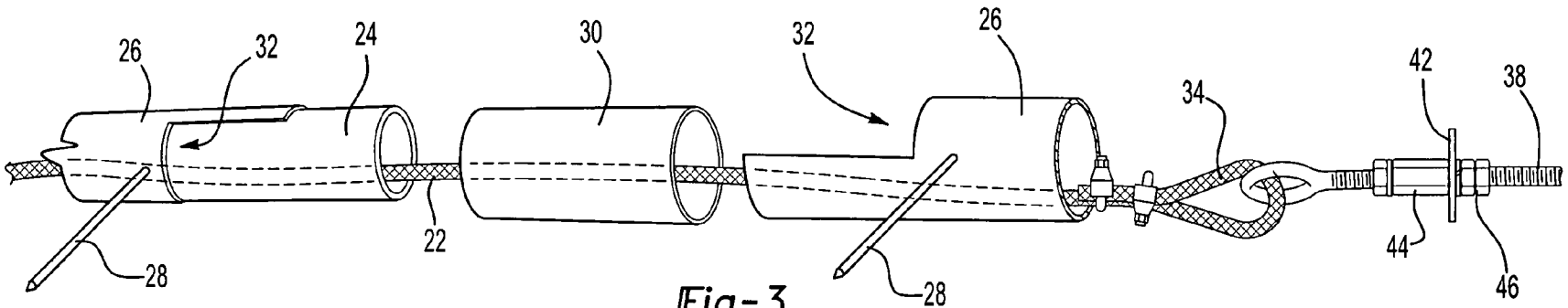
FIG. 3 is an exploded side view of the components of the embodiment of the discharge electrode shown in the previous figures including an embodiment of a tensioning member.

In one preferred embodiment, the components 20 are further compressed into a rigid unitary discharge electrode by tensioning the cable 22 against the end components of the replacement discharge electrode as shown in FIGS. 2 and 3. In the disclosed embodiment, a metal tensioning reinforced loop 34 is formed on the ends of the cable 22 and secured in place with lock fasteners 36 as best shown in FIG. 3. A threaded metal tightening rod 38 in the form of an I-bolt is received in the loop 34 having a male threaded end 40. A washer 42 is telescopically received on the male threaded end 40 of the tightening rod 38, and female threaded member 44 is threadably received on the threaded end 40 of the tightening rod and jam nuts 46 are threadably received on the threaded end 40 of the tightening rod 38 as best shown in FIG. 3. The end members of the discharge electrodes may be flared, as shown at 48 in FIG. 2, such that the washer 42 abuts an end surface of the end sections of the tubular discharge electrodes 26, permitting tightening of the cable 22 to form a rigid unitary tubular discharge electrode from the loosely assembled components 20 as shown in FIG. 2. Following tightening or tensioning of the cable 22, the threaded member 44 or jam nuts 46 may be welded and the excess cut off.

Figure 4:
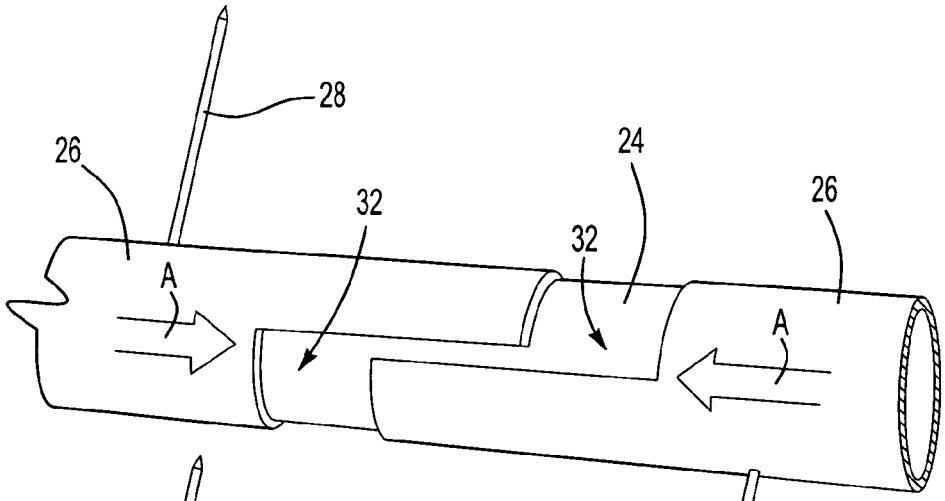
FIGS. 4 to 6 are side views of the tubular component of the embodiment of the replacement discharge electrode illustrated in the prior figures illustrating one preferred telescopic method of assembly of the components.
Figure 5:
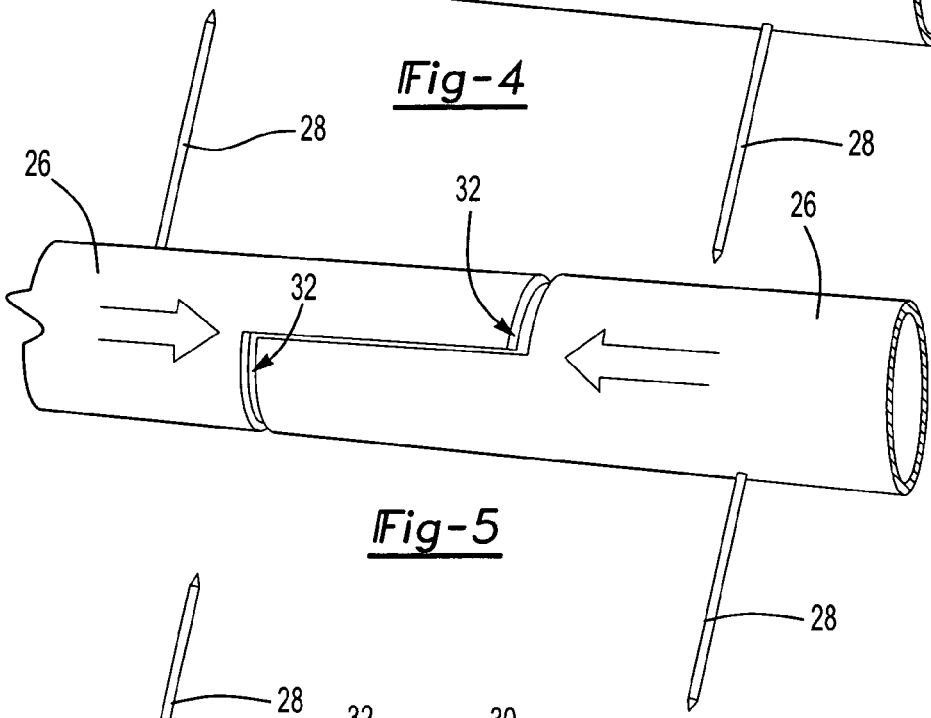
Figure 6:
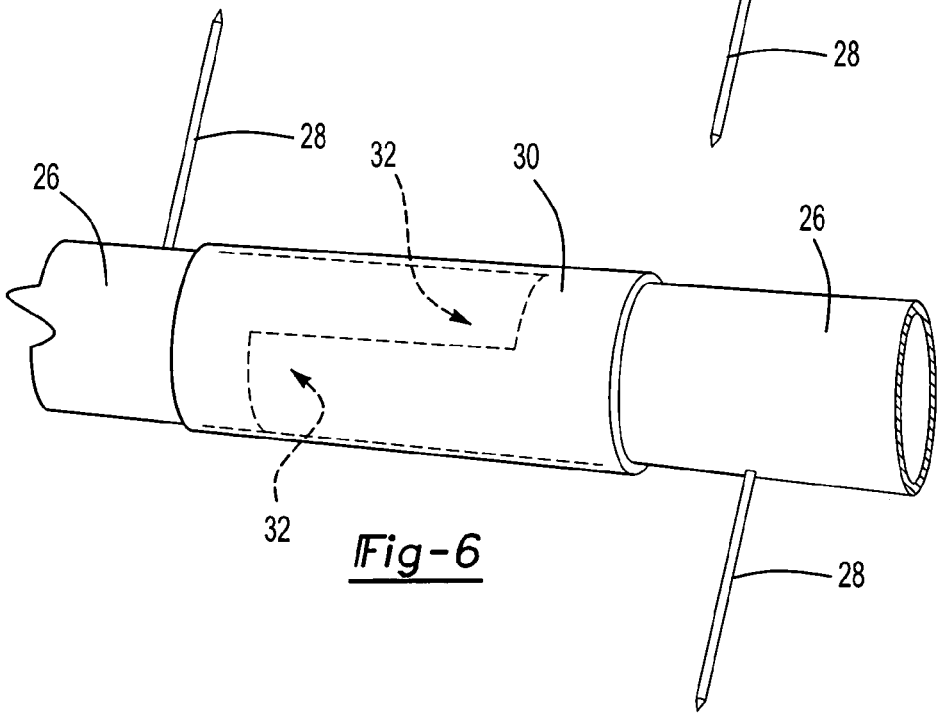

FIGS. 4 to 6 further illustrate one preferred embodiment of the method of assembly of the primary components of the disclosed embodiment of the collapsible mast-type replaceable discharge electrode of this invention, including a center support tube 24, abuttable tubular sections 26 and an outer sleeve 30. As shown in FIG. 4, the center support tube 24 has an outer diameter substantially equal to but less than an inner diameter of the abutting tubular sections 26. As described above, the abutting tubular sections 26 each include right angled interfitting notches 32. Thus, the abutting tubular sections 26 are telescopically received on the center support tube 24 with the right angled notches 32 aligned, as shown in FIG. 4, and the abutting tubular sections 26 are then pressed together as shown by arrows A, until the right angled notches 32 fully nest. Finally, FIG. 6 illustrates the final assembly of these components, wherein the rectangular notches 32 shown in FIGS. 4 and 5 are fully nested as shown in phantom in FIG. 6 and the outer tubular sleeve or collar 30 is telescopically received over the nested right angled notches 32 as shown in FIG. 6. As best shown in FIG. 1B, however, the outer tubular sleeve 30 in this embodiment must be first received over one of the ends of the abutting tubular sections 26 because of the discharge electrode surface emission elements or spikes 28 would otherwise interfere with the assembly of the outer tubular collars 30 over the end of the opposed abutting tubular section 26.

Figure 7:
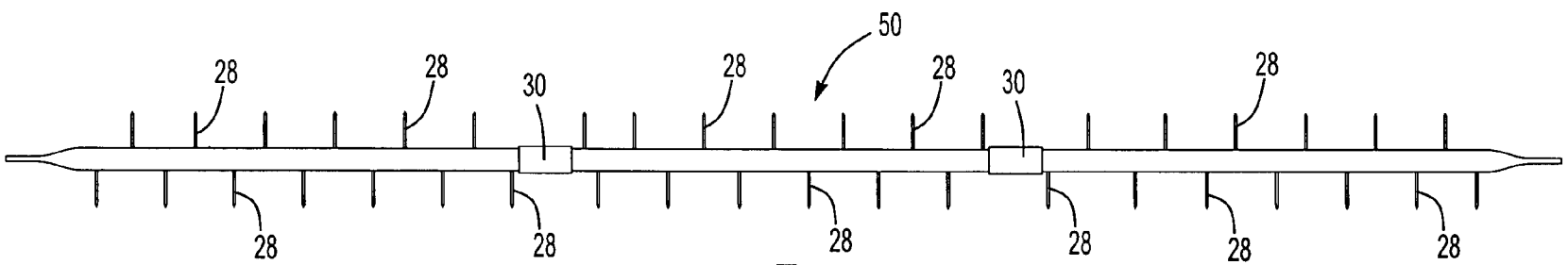
FIG. 7 is a side view of the embodiment of the replacement discharge electrode of this invention fully assembled.

As described above, the assembled components of the discharge electrode are then tensioned or compressed into a rigid mast-type discharge electrode. FIG. 7 illustrates a fully assembled discharge electrode 50 ready for final installation in an electrostatic precipitator (not shown). As described above and shown in the figures of this application, the embodiment of the discharge electrode 50 disclosed herein may be assembled with conventional tools and without welding. The components of the discharge electrode of this invention may also be assembled in an electrostatic precipitator as the assembly is raised on a winch or the like between adjacent electrode plates. That is, each coupling assembly shown in FIGS. 4 to 6 (which are loosely assembled on a cable, not shown in these figures), each assembled coupling may then be raised and another coupling assembly assembled on the tensioning cable. Once the coupling is together, rubber bands (not shown) may be slipped over the corona generating devices 28, then the assembled components of discharge electrode may be raised so that the next connection can be made. The rubber bands may remain in place as they are non-conductive and will not adversely affect the precipitator function and will soon decay in the electrostatic precipitator environment.

Having described one preferred embodiment of a collapsible mast-type replacement discharge electrode, the method of assembling the discharge electrodes of this invention will now be understood from the above description. Thus, the method of this invention includes loosely assembling components of a replacement electrode on a cable, moving the assembly between or adjacent to the collecting electrodes (not shown) of the electrostatic precipitator, tightening or tensioning the cable to form a unitary rigid replacement discharge electrode and mounting the unitary rigid discharge electrode between collecting electrodes in the electrostatic precipitator generally as shown in the above-referenced U.S. patent. In a preferred embodiment, the method of this invention includes collapsing or "folding" the components of the replacement discharge electrode before moving the components between the adjacent collecting electrodes. That is, as described above, the components 20 may be folded around the flexible cable 22 into any desired configuration for receipt through available openings in the electrostatic precipitator chamber containing the collecting electrodes. In one preferred embodiment, the assembly of the components of the replacement electrode includes telescopically receiving the tubular sections 26 of the discharge electrode over the center support tubes 24 and then telescopically receiving a tubular collar 30 over the abutting tubular sections 26 as described above. The method of tensioning the cable 22 preferably includes tensioning the cable against the end tubular sections 26 of the discharge electrode 50 as described above. However, any method of tensioning the cable 22 to place the components 20 under compression would be suitable for the method of this invention. However, as set forth above, the sequence of assembly of the components 20 of the replacement discharge electrode of this invention will depend upon the application. The fully assembled replacement discharge electrode may be assembled and placed between existing collecting electrodes as shown in the above-referenced U.S. patent on brackets or in existing holes, etc.

As will now be understood, the replacement discharge electrode and method of assembly of this invention has several advantages over the prior art including, but not limited, to the following: The horizontal and vertical joining design assures correct alignment of the corona generating devices for spikes by permitting only one-way assembly of the coupling. The design also allows a larger amount of surface area on the mating surfaces to increase the amount of the electrically conducted area. This assures adequate electrical conductivity and reduces the possibility of electrical erosion. The internal or center support tubes 24 provide reinforcement for the joints between the abutting tubular sections 26 for at least twelve inches above and below the connection point. The center support tubes 24 also act as a guide to assure complete straightness of the electrode connection. As set forth above, the center support tubes 24 may be welded into one of the mating discharge electrode tubular sections 26 and has a snug fit in the other. This design prevents failure of the connection by acting as a positive surface guide to prevent one half of the discharge electrode from slipping under the other half and "telescoping." This 360° internal surface also contributes several square inches of conductive surface to prevent joint failure due to electrical erosion. The joint between the abutting tubular sections 26 is further protected by the outer tubular sleeves or collars 30. The sleeves or collars 30 also prevent compression joint failure by making it impossible for the outer edges of the tubular sections from passing outwardly and then over each other in external telescoping. The outer sleeves 30 also provide additional conductive surface and also acts as a protective covering for the entire connection.

In this preferred embodiment, all components of the discharge electrode telescopically slide together without the use of tools or welding and are forced together due to the action of the compression cable 22. The assembled couplings of the discharge electrode provides a smooth, uniform surface because there are no protruding connection devices. The uniform surface also helps provide even corona distribution that may otherwise be lost if the joint system contained mechanical, conductive protrusions. Further, as described above, no special tools are required to assemble the replacement discharge electrode of this invention. The replacement discharge electrode of this invention provides uniform "top-to-bottom" cleaning that may equal or surpass that of a conventional one-piece electrode, because the outer wall of the discharge electrode is already under linear stress. The flexible cable 22 also assures correct assembly of the components and prevents dropping of any of the components prior to final assembly.

Having described a preferred embodiment of the replacement discharge electrode of this invention and method of assembly, it will be understood that various modifications may be made to the collapsible mast-type electrode and method for this invention within the purview of the appended claims. For example, as set forth above, the cable 22 may be tensioned and the components compressed by any suitable means. Further, the notches 32 in the abutting ends of the tubular sections 26 are optional, but provide further advantages as described above. Further, the components of the replacement discharge electrode of this invention may be loosely assembled on a cable and finally assembled by tensioning the cable in any sequence at any convenient location:

Having described a preferred embodiment of the replacement discharge electrode and method of assembly of this invention, the invention is now claimed as follows:

1. A collapsible mast replacement discharge electrode for an electrostatic precipitator, comprising:

a plurality of tubular telescopically assemblable discharge electrode elements;

a flexible cable loosely received through said tubular telescopically assemblable discharge elements permitting receipt of an assembly of said tubular telescopically assemblable discharge elements in a folded or semi-folded assembly between or adjacent collecting electrodes of an electrostatic precipitator; and a tensioning element, tensioning said cable when said tubular telescopically assemblable discharge electrode elements are telescopically assembled into a rigid unitary tubular replacement discharge electrode.

2. The collapsible mast replacement discharge electrode as defined in claim 1, wherein said plurality of tubular telescopically assemblable discharge elements includes abutting tubular sections of said discharge electrode and sleeves telescopically receivable over said tubular sections.

3. The collapsible mast replacement discharge electrode as defined in claim 1, wherein said tubular telescopically assemblable discharge electrode elements include center support tubes telescopically received within abutting tubular sections of said discharge electrode.

4. The collapsible mast replacement discharge electrode as defined in claim 3, wherein one of said tubular sections of said discharge electrode is welded to a center support tube.

5. The collapsible mast replacement discharge electrode as defined in claim 1, wherein said tubular telescopically assemblable discharge electrode elements include a plurality of abutting tubular sections of said discharge electrode telescopically received over center support tubes, and tubular sleeves telescopically received over abutting ends of said tubular sections, forming a rigid unitary replacement discharge electrode upon tensioning of said cable.

6. The collapsible mast replacement electrode as defined in claim 1, wherein said plurality of tubular telescopically assemblable discharge elements include abutting tubular sections each having a nestable right angled notch and a tubular sleeve having an internal diameter slightly greater than an outer diameter of said abutting tubular sections telescopically received over said abutting tubular sections.

7. A collapsible mast replacement discharge electrode for an electrostatic precipitator, comprising:

a plurality of tubular telescopically assemblable discharge electrode components, including a plurality of abuttable tubular sections each having substantially the same diameter, and a plurality of tubular outer collars telescopically receivable over opposed ends of said abuttable tubular sections;

a cable loosely received through said tubular telescopically assemblable discharge electrodes permitting receipt of said plurality of telescopically assemblable discharge components to collapse in a folded or semi-folded assembly between adjacent collecting electrodes of an electrostatic precipitator; and a tensioning element, tensioning said cable when said tubular telescopically assemblable discharge electrode components are telescopically received into a rigid unitary tubular replacement discharge electrode.

8. The collapsible mast replacement discharge electrode as defined in claim 7, wherein said plurality of telescopically assemblable discharge electrode components further include center support tubes having an outer diameter generally equal to or less than an inner diameter of said abuttable tubular section and telescopically receivable in opposed ends of said abuttable tubular sections.

9. The collapsible mast replacement discharge electrode as defined in claim 7, wherein said abuttable tubular sections each include a notch nestable in an opposed abbutable tubular section.

10. The collapsible mast replacement discharge electrode as defined in claim 7, wherein said notches are right angled.

11. A method of assembling a replacement discharge electrode in an electrostatic precipitator, comprising the following steps:

loosely assembling components of a replacement discharge electrode on a cable;

moving the assembly between or adjacent collecting electrodes of an electrostatic precipitator;

tensioning the cable to form a unitary co-linear rigid discharge electrode; and mounting said unitary co-linear rigid discharge electrode between collecting electrodes in said electrostatic precipitator.

12. The method as defined in claim 11, wherein said method includes folding the loosely assembled components of the replacement discharge on the cable before moving the components between or adjacent the collecting electrodes of the electrostatic precipitator.

13. The method as defined in claim 11, wherein said method includes assembling the components of the replacement discharge electrode by abutting shorter sections of the replacement discharge electrode and telescopically receiving tubular collars over the abutting ends of the shorter sections.

14. The method as defined in claim 11, wherein said method includes assembling tubular components of said replacement discharge electrode over center support tubes into abutting relation, then telescopically receiving tubular collars over the abutting tubular sections, and then tightening the cable to form the unitary rigid discharge electrode.

15. A method of assembling a replacement mast discharge electrode for an electrostatic precipitator, comprising the following steps:

loosely assembling tubular components of a replacement discharge electrode on a cable, including abuttable tubular sections adapted to telescopically receive said tubular sections;

telescopically assembling the tubular components on the cable;

tensioning the cable to form a rigid unitary co-linear replacement discharge electrode; and mounting the rigid unitary discharge electrode between collecting electrodes of an electrostatic precipitator.

16. The method of assembling a replacement discharge electrode as defined in claim 15, wherein the tubular sections have an outer diameter generally equal to or less than the abuttable tubular sections, and said method including telescopically receiving said abuttable tubular sections over said tubular sections.

17. The method as defined in claim 16, wherein said tubular sections have an inner diameter generally equal to an outer diameter of said abuttable tubular sections, and said method including telescopically receiving said tubular sections over abutting ends of said abuttable tubular sections.

18. The method as defined in claim 16, wherein the tubular sections each include a notch nestable in an opposed abuttable tubular section, wherein said method includes abutting said abuttable tubular sections with the notches nested.

* * * * *

UNITED STATES PATENT AND TRADEMARK OFFICE

CERTIFICATE OF CORRECTION

PATENT NO. : 7,399,340 B2
APPLICATION NO. : 11/448329
DATED : July 15, 2008
INVENTOR(S) : Robert A. Strauss It is certified that error appears in the above-identified patent and that said Letters Patent is hereby corrected as shown below:

On the cover, assignee line, please delete “Research_Cottrell” and replace with

--Research-Cottrell--.

In column 9, line 32, please insert --electrode-- between “discharge” and “on.”.

Signed and Sealed this

Sixteenth Day of December, 2008

JON W. DUDAS
*Director of the United States Patent and Trademark Office*